US006341442B1

(12) United States Patent
Szabo et al.

(10) Patent No.: US 6,341,442 B1
(45) Date of Patent: Jan. 29, 2002

(54) DOUBLE ACTION PISTOL

(75) Inventors: Atilla Szabo, Toronto; Borislav B. Vulanovic, Pickering, both of (CA)

(73) Assignee: Angelotti, Inc., Scarborough (CA)

( * ) Notice: Subject to any disclaimer, the term of this patent is extended or adjusted under 35 U.S.C. 154(b) by 0 days.

(21) Appl. No.: 09/635,925

(22) Filed: Aug. 10, 2000

Related U.S. Application Data

(62) Division of application No. 09/139,027, filed on Aug. 24, 1998, now Pat. No. 6,283,006.

(51) Int. Cl.[7] ..... F41A 17/26

(52) U.S. Cl. ..... 42/70.08; 42/69.03; 89/147; 89/148

(58) Field of Search ..... 42/70.08, 69.03; 89/142, 147, 148

(56) References Cited

U.S. PATENT DOCUMENTS

| | | | | |
|---|---|---|---|---|
| 984,519 | A | 2/1911 | Browning | 89/138 |
| 3,733,730 | A | 5/1973 | Baker | 42/65 |
| 4,138,789 | A | 2/1979 | Langsford | 42/65 |
| 4,589,327 | A | 5/1986 | Smith | 89/148 |
| 4,862,618 | A | 9/1989 | Szabo | 42/7 |
| 5,160,796 | A | 11/1992 | Tuma et al. | 89/147 |
| 5,166,458 | A | 11/1992 | Yoo | 42/69.03 |
| 5,400,537 | A | 3/1995 | Meller et al. | 89/147 |
| 5,635,663 | A * | 6/1997 | Krieger et al. | 42/69.03 |
| 5,815,973 | A * | 10/1998 | Hochstrate | 42/69.03 |
| 5,915,935 | A * | 6/1999 | Weldle et al. | 42/69.03 |

FOREIGN PATENT DOCUMENTS

| | | |
|---|---|---|
| DE | 132 762 | 8/1902 |
| EP | 0 982 557 A3 | 3/2000 |

OTHER PUBLICATIONS

Garry James and Jeff John, "Para–Ordnance Goes Double Action", *Guns & Ammo*, pp. 60–66 (Dec., 1998).
Colt Double Eagle Price List, Handgun–Autoloaders, Service & Sport (Handgun announced in 1989).
Three pictures of the Colt Double Eagle: no date.

* cited by examiner

*Primary Examiner*—Stephen M. Johnson
(74) *Attorney, Agent, or Firm*—Finnegan, Henderson, Farabow, Garrett & Dunner, L.L.P.

(57) ABSTRACT

A double action pistol having a frame is disclosed. A sear is mounted on the frame. A hammer cam is position adjacent the sear and linked to a hammer spring. The hammer cam is engageable with the sear to hold the hammer spring in a compressed position. A hammer is detachably coupled to the hammer cam. A return spring biases the hammer away from the hammer cam when the hammer spring is compressed. A drawbar is operable to engage the hammer to retract the hammer and disengage the sear from the hammer cam to release the hammer spring. The hammer spring acts on the hammer through the hammer cam to move the hammer to fire the pistol.

25 Claims, 17 Drawing Sheets

DOUBLE ACTION PISTOL

This is a division of application Ser. No. 09/139,027, filed Aug. 24, 1998 now U.S. Pat. No. 6,283,006.

BACKGROUND OF THE INVENTION

The present invention relates to a double action pistol. More particularly the invention relates to a firing assembly for a double action pistol.

Pistols can generally be classified as either single action or double action depending upon the firing action the pistol. In a single action pistol, the hammer must be manually cocked before the pistol can be fired. It should be noted that many guns are hammer-less but have internal strikers that hit a firing pin in analogous function to a hammer. For purposes of describing the present invention the term hammer includes strikers or the like. A hammer is cocked by pivoting the hammer rearwardly into engagement with a sear. The rearward rotation of the hammer causes a hammer spring to be compressed and the sear engages the hammer to maintain the compression of the spring. The trigger can then be pulled to fire the pistol. The trigger pull causes the sear to disengage from the hammer, thereby allowing the hammer spring to act on the hammer to fire the pistol. This method of operation is known as a single action because the trigger pull accomplishes the single action of disengaging the sear from the hammer.

In a double action pistol, the trigger pull performs two actions. The first part of the double action trigger pull cocks the hammer and compresses the hammer spring and the second part of the trigger pull releases the hammer to fire the pistol. Because the double action trigger pull must rotate the hammer into engagement with the sear and compress the hammer spring, the typical double action trigger pull is longer and requires greater force than the typical single action trigger pull.

In some double action pistols, commonly referred to as conventional double action pistols, the recoil action of the pistol is used to re-cock the hammer for the next shot. The pistol then operates similar to a single action in that each subsequent trigger pull must only release the hammer to fire the next shot. In other double action pistols, commonly referred to as double action only pistols, the hammer returns to the uncocked position after each round is fired. Thus, the trigger pull in a double action only pistol cocks the hammer on every trigger pull.

Double action pistols are generally considered safer than single action pistols because the longer trigger pull of the double action means that a more deliberate action on the part of the user is needed to fire the pistol. Thus, the double action pistol is less susceptible to accidental shootings caused by stress induced loss of fine motor skills.

However, double action pistols are also generally considered less accurate than single action pistols. The reduced accuracy is a result of the double action pistol compressing the hammer spring as part of the trigger pull. Because the hammer spring must be compressed, the force required to pull the trigger is greater in a double action pistol than a single action. This increased force, in combination with the longer trigger pull, makes accurate shooting more difficult. In addition, in a conventional double action pistol, the force required pull the trigger on the second shot is less than the force required on the first shot because the recoil action compresses the hammer spring and the force on the trigger must merely release the sear. Thus, the user encounters inconsistent trigger forces, which may further disrupt shooting accuracy.

In light of the foregoing there is a need for a pistol that includes the safety benefits of the longer pull of the double action with the consistent trigger force of a single action.

SUMMARY OF THE INVENTION

Accordingly, the present invention is directed to a double action pistol that obviates one or more of the limitations and disadvantages of the prior art double action pistols. The advantages and purposes of the invention will be set forth in part in the description which follows, and in part will be obvious from the description, or may be learned by practice of the invention. The advantages and purposes of the invention will be realized and attained by the elements and combinations particularly pointed out in the appended claims.

To attain the advantages and in accordance with the purposes of the invention, as embodied and broadly described herein, the invention is directed to a double action pistol including a frame. A sear is disposed on the frame and a hammer cam is disposed adjacent the sear. The hammer cam is linked to a hammer spring by a strut. The hammer cam rotates from an uncocked position to a cocked position to compress the hammer spring. In the cocked position, the sear engages the hammer cam to maintain the compression of the hammer spring. There is provided a hammer disposed on the frame and detachably coupled with the hammer cam. There is further provided a return spring that acts to bias the hammer out of engagement with the hammer cam when the hammer cam is in the cocked position. There is also provided a drawbar slidably disposed in the frame. The drawbar moves the hammer into close proximity of the hammer cam and disengages the hammer cam from the sear to release the hammer spring and thereby fire the pistol.

According to another aspect, the invention is directed to a double action pistol including a frame. A sear is disposed on the frame and a hammer cam is disposed adjacent the sear. The hammer cam is linked to a hammer spring by a strut having a boss. The hammer cam rotates from an uncocked position to a cocked position to compress the hammer spring. In the cocked position, the sear engages the hammer cam to maintain the compression of the hammer spring. There is provided a hammer disposed on the frame and detachably coupled with the hammer cam. There is also provided a drawbar slidably disposed in the frame. The drawbar is prevented from sliding by the boss on the strut when the hammer cam is in the uncocked position. When the hammer cam is in the cocked position, the drawbar is operable to move the hammer into close proximity of the hammer cam and then disengage the sear from the hammer cam to release the hammer spring and thereby fire the pistol.

In another aspect, the invention is directed to a double action only pistol including a frame. A sear is disposed on the frame and a hammer cam is disposed adjacent the sear. The hammer cam is linked to a hammer spring by a strut. The hammer cam rotates from an uncocked position to a cocked position to compress the hammer spring. In the cocked position, the sear engages the hammer cam to maintain the compression of the hammer spring. There is provided a hammer disposed on the frame and detachably coupled with the hammer cam. The hammer includes a half-cock notch configured to engage the sear. The hammer is biased into the half-cocked position by a return spring when the hammer cam is in the cocked position. There is also provided a drawbar slidably disposed in the frame. The drawbar moves the hammer into close proximity of the hammer cam and disengages the hammer cam from the sear to release the hammer spring and thereby fire the pistol.

In still another aspect, the invention is directed to an improvement in a 1911A1 model style pistol. The improvement includes a hammer cam disposed adjacent the sear. The hammer cam is linked to a hammer spring by a strut. The hammer cam rotates from an uncocked position to a cocked position to compress the hammer spring. In the cocked position, the sear engages the hammer cam to maintain the compression of the hammer spring. There is provided a hammer rotatably disposed on the frame and detachably coupled with the hammer cam. There is further provided a return spring that acts to bias the hammer out of engagement with the hammer cam when the hammer cam is in the cocked position. There is also provided a drawbar slidably disposed in the frame. The drawbar rotates the hammer into close proximity of the hammer cam and disengages the hammer cam from the sear to release the hammer spring and thereby fire the pistol.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. In the drawings.

DETAILED DESCRIPTION

Reference will now be made in detail to the presently preferred embodiments of the invention, examples of which are illustrated in the accompanying drawings. Wherever possible, the same reference numbers will be used throughout the drawings to refer to the same or like parts.

Figure 1:
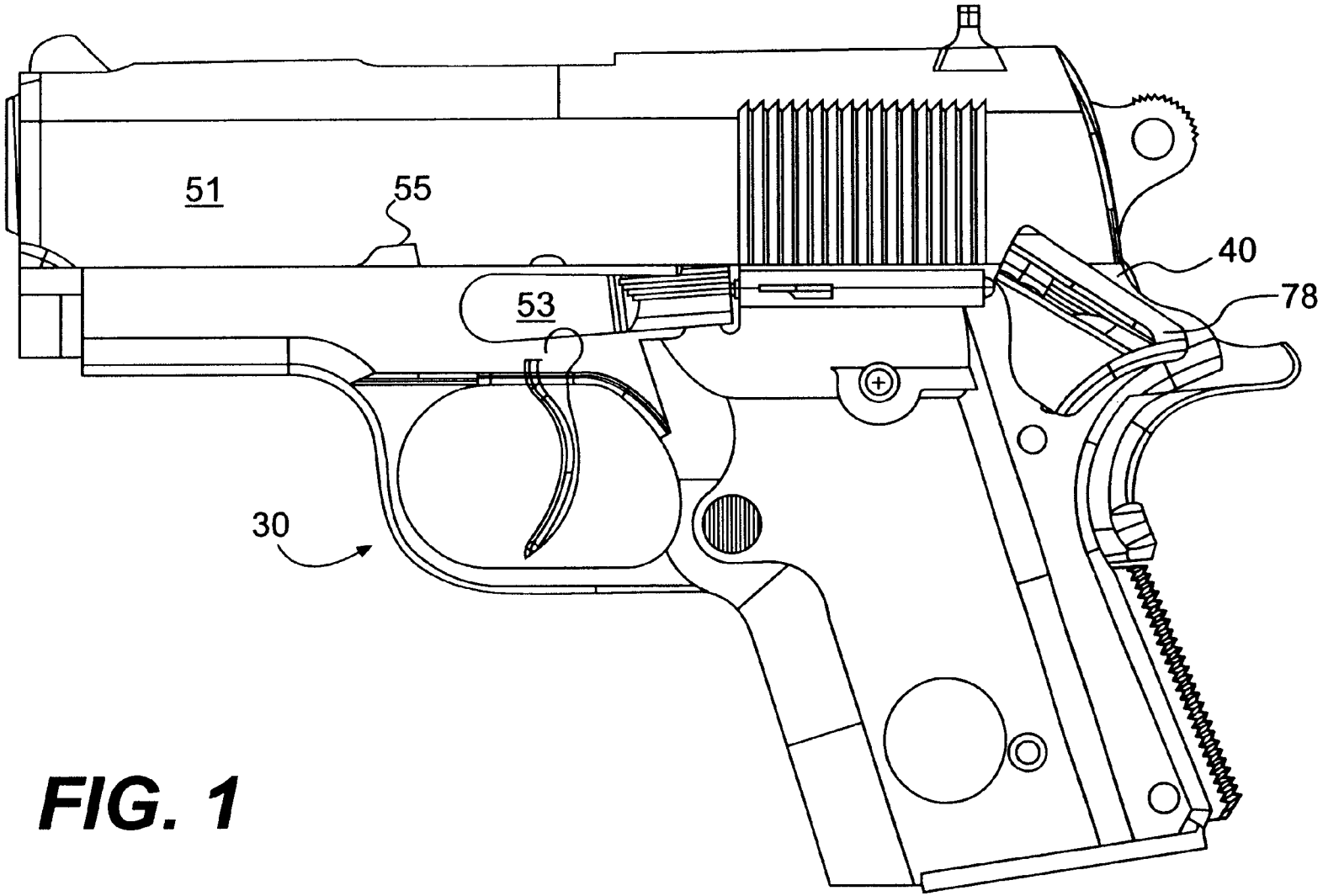
FIG. 1 is a side pictorial view of the pistol of the present invention.

In accordance with the present invention, a double action pistol is provided. There is disclosed by way of example a model 1911A1 semi-automatic handgun. The 1911A1 model handgun is disclosed in U.S. Pat. No. 984,519, which is hereby incorporated by reference. U.S. Pat. No. 984,519 discloses the overall structure and operation of the 1911A1 model handgun and its disclosure of the basic structural components and operation will not be repeated. While the exemplary embodiments depict a 1911A1 model handgun, it is contemplated that the present invention may be used with any double action handgun readily apparent to one skilled in the art. A 1911A1 model handgun is shown in FIG. 1 and is designated generally by reference number 30.

Figure 2:
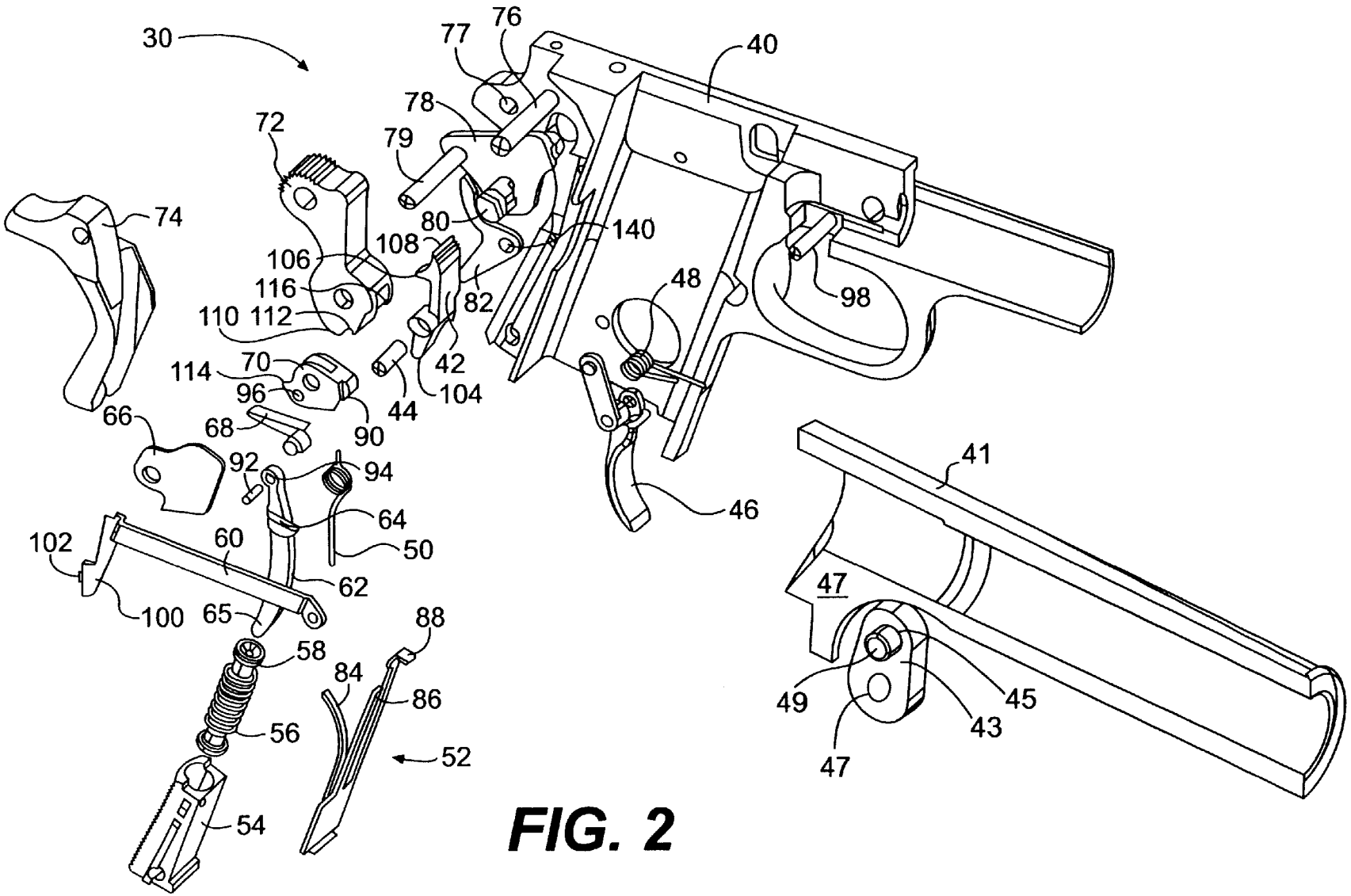
FIG. 2 is an exploded view of the pistol of the present invention.
Figure 13:
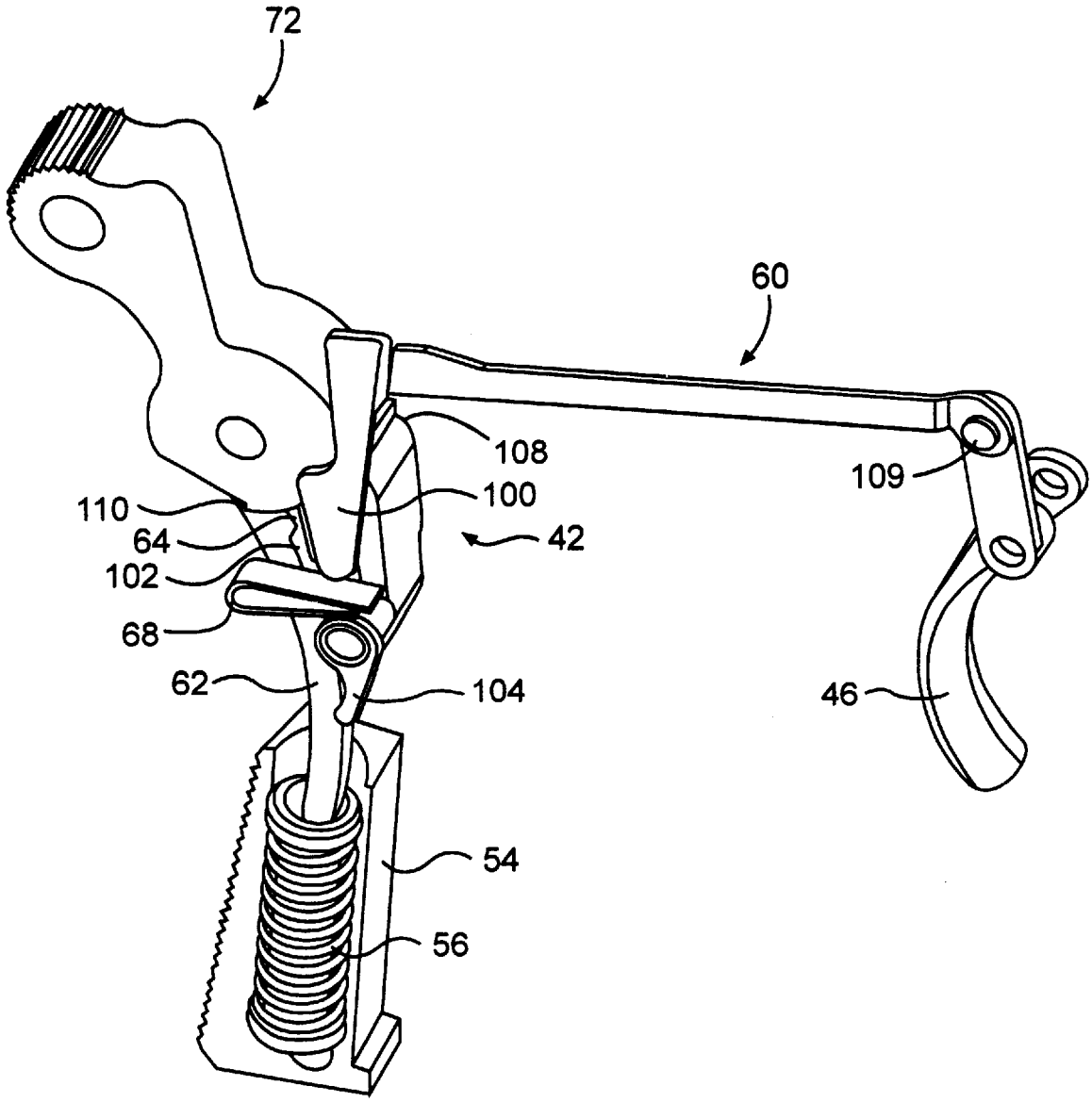
FIG. 13 is a partial pictorial view of the trigger and firing assemblies of the present invention, illustrating the uncocked position.

As best illustrated in FIG. 2, the pistol of the present invention includes a frame 40. A trigger 46 is pivotally disposed on frame 40 with a trigger pin 98. A trigger spring 48 is positioned adjacent trigger 46 and biases trigger 46 to a forward position. As shown in FIG. 13, trigger 46 is connected to a drawbar 60 with a pin 109.

Drawbar 60 is slidably disposed in frame 40 and has a rear leg 100. A tab 102 extends from rear leg 100. A drawbar spring 68 acts on rear leg 100 to bias drawbar 60 upwardly.

The pistol also includes a sear 42 that is preferably rotatably mounted on a sear pin 44. Sear 42 has a lower tab 104, a drawbar contact 106, and a main contact 108. Sear 42 is positioned adjacent a hammer cam 70 and proximate a leaf spring 52. Leaf spring 52 has a sear prong 86 that contacts lower tab 104 of sear 42 to bias main contact 108 of sear 42 towards hammer cam 70. It is contemplated that the present invention applies to sears that are not rotatably mounted, such as, for example, a linear moving or floating arrangement.

As also shown in FIG. 2, handgun 30 includes a barrel 41. A linking member 43 connects barrel 41 to frame 40. Linking member 43 has a first opening 45 and a second opening 47. First opening 43 is configured to receive a pin 49 that is connected to barrel 41. Second opening 47 is configured to receive trigger pin 98. Linking member 43 may pivot relative to pin 49 and trigger pin 98. This connection allows barrel 41 to pivot relative to frame 40.

Handgun 30 also includes a slide 51 that is mounted on frame 40 for sliding movement between a forward position and a rearward position. Slide 51 includes a notch 55. A slide stop 53 is mounted on frame 40. Slide stop 53 is configured to engage notch 55 to prevent slide 51 from moving to the forward position after the last round of ammunition has been fired from the handgun.

The hammer cam 70 is rotatably mounted on a hammer pin 76. Hammer cam 70 has a first engagement step 90 and a second engagement step 114. Hammer cam 70 is connected to a strut 62 by a pin 92 that engages an opening 96 in the hammer cam and an opening 94 in strut 62. The strut 62 connects hammer cam 70 to a hammer spring 56. Strut 62 has a boss 64 and a lower end 65. Lower end 65 of strut 62 engages a plug 58 that fits within hammer spring 56. Hammer spring 56 is supported by handle 54.

The pin 92 and opening 96 in hammer cam 70 are positioned such that the rotation of the hammer cam results in a generally downward motion of strut 62. The generally downward motion of strut 62 compresses hammer spring 56. The compressed hammer spring 56 acts on hammer cam 70 through strut 62 to bias the hammer cam to rotate about hammer pin 76.

In accordance with the present invention, the hammer cam is moveable between a cocked position and an uncocked position. In the cocked position, the hammer cam is engaged with the sear to hold the hammer spring in a compressed position. In the uncocked position, the hammer spring is released.

Figure 3:
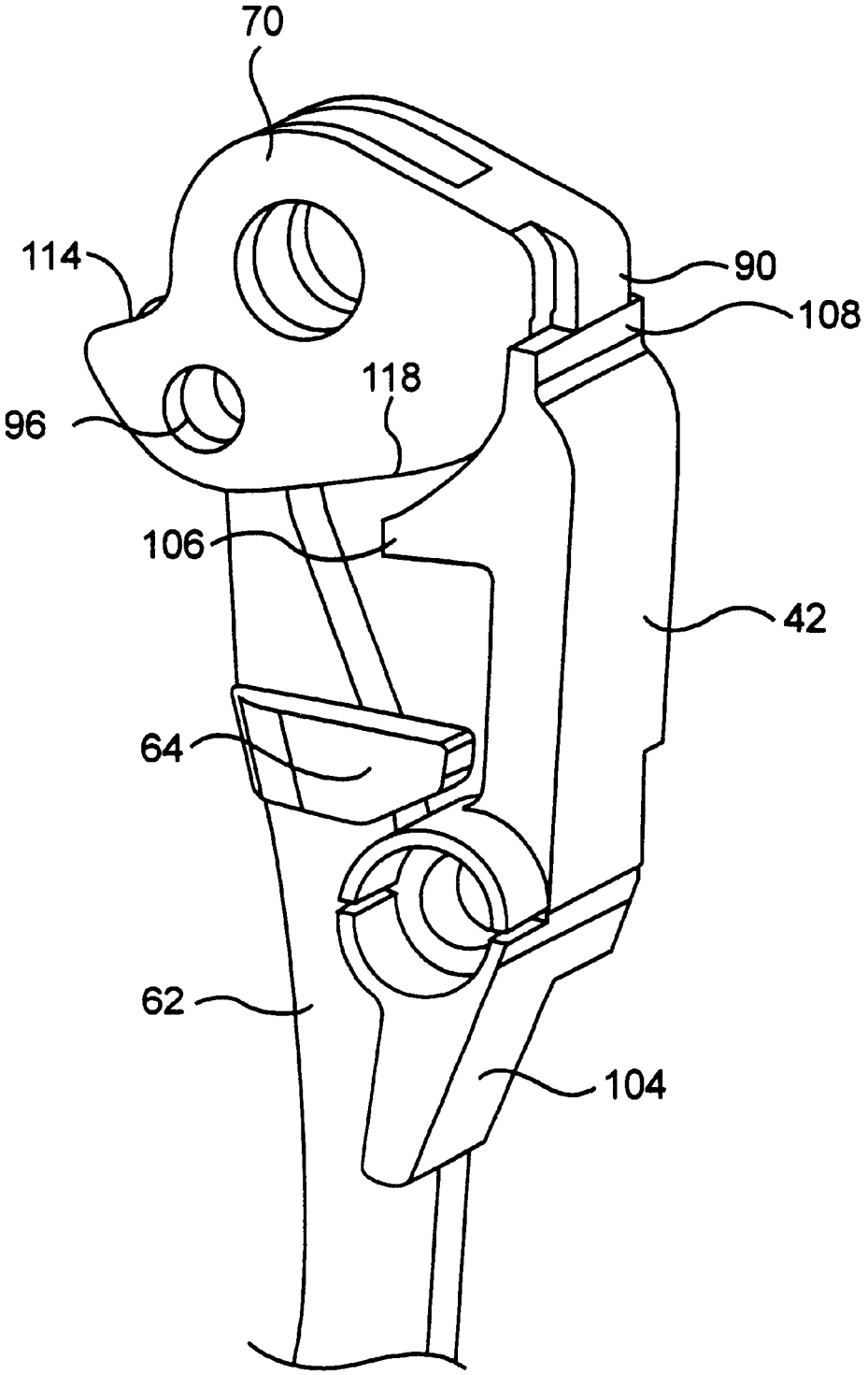
FIG. 3 is a pictorial view of a hammer cam according to the present invention.

As illustrated in FIG. 3, the hammer cam 70 is rotated into a cocked position. In the cocked position, main contact 108 of sear 42 engages first engagement step 90 of hammer cam 70. The rotation of hammer cam 70 to reach this position moves strut 62 generally downward to compress hammer spring 56. The engagement of sear 42 with hammer cam 70 holds hammer spring 56 in the compressed position.

The hammer cam 70 rotates to the uncocked position when sear 42 is disengaged from the hammer cam to release hammer spring 56. The released hammer spring 56 acts on hammer cam 70 through strut 62. The action of hammer spring 56 rotates hammer cam 70 back to the uncocked position.

In accordance with the present invention, a hammer is rotatably disposed on the frame and detachably coupled to the hammer cam. A return spring acts on the hammer to bias the hammer away from the hammer cam when the hammer cam is in the cocked position. It should be noted that the term hammer as used throughout this disclosure is intended to include the exemplary embodiment of the hammer as well any other hammer configurations, including internal strikers or the like, that are readily apparent to one skilled in the art.

As embodied herein and shown in FIG. 2, the pistol 30 includes a hammer 72, a hammer pin 76, and a hammer return spring 50. The hammer 72 is rotatably mounted on hammer pin 76. The hammer return spring 50 acts on the hammer 72 to rotate it about the hammer pin 76.

Figure 4A:
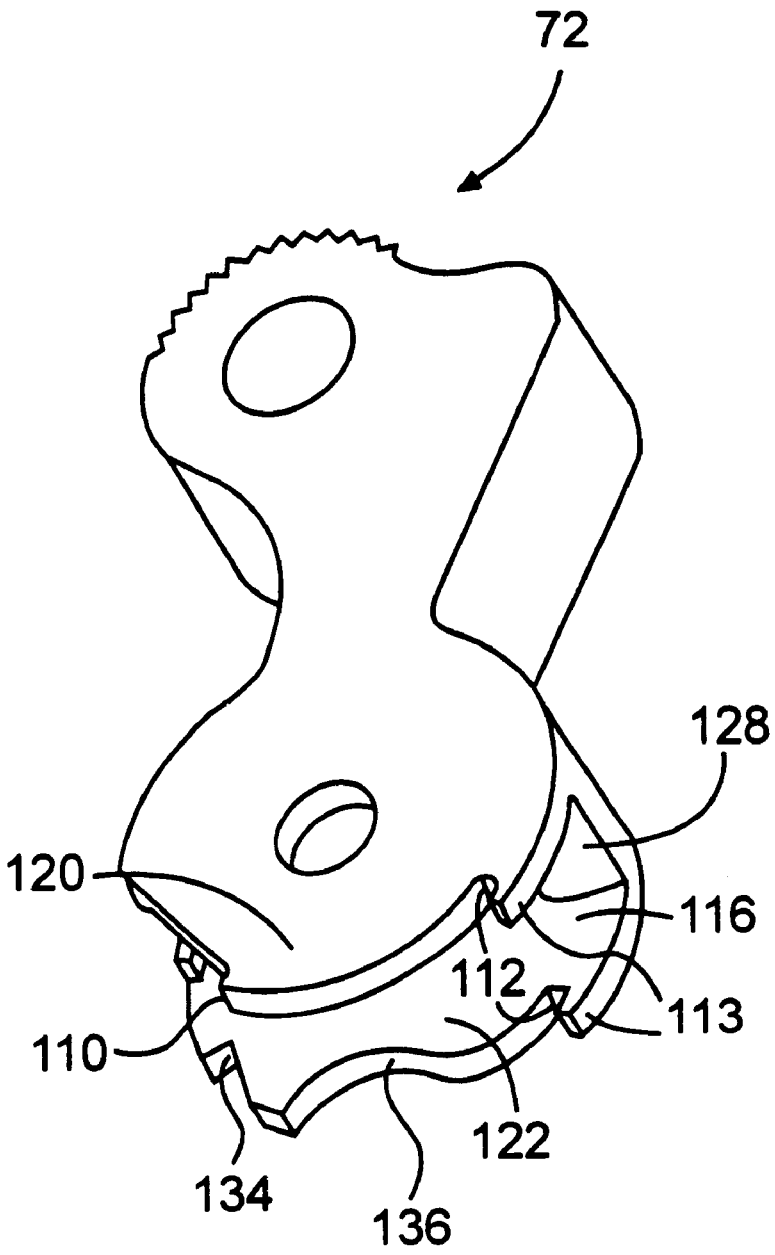
FIG. 4*a* is a pictorial view of a hammer according to the present invention.
Figure 4B:
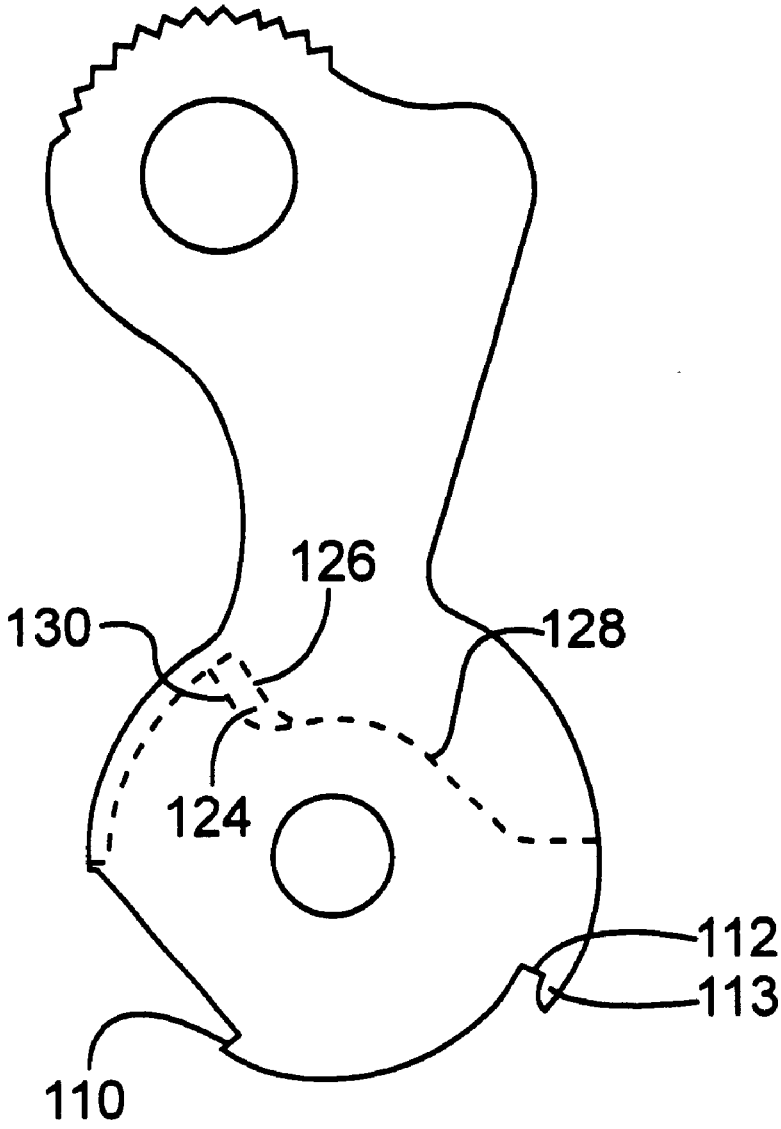
FIG. 4*b* is a side view of the hammer of FIG. 4*a;*

In the preferred embodiment illustrated in FIG. 4*a*, hammer 72 has a first side support 120 and a second side support 122. The first and second side supports 120 and 122 define a slot 116 having an interior surface 128. As illustrated in FIG. 4*b*, a groove 124 is positioned at the rear of interior surface 128 to form a cam contact 130 and a return spring contact 126. Alternatively, the cam may be positioned exterior to the hammer.

As shown in FIG. 4*a*, the outer edge of first side support 120 defines a drawbar notch 110. The outer edge of second side support 122 defines a grip safety notch 134 and a manual safety groove 136. The outer edges of each of the first and second side supports 120 and 122 also include a half-cock notch 112. Each half-cock notch 112 has an outer tab 113.

Figure 5:
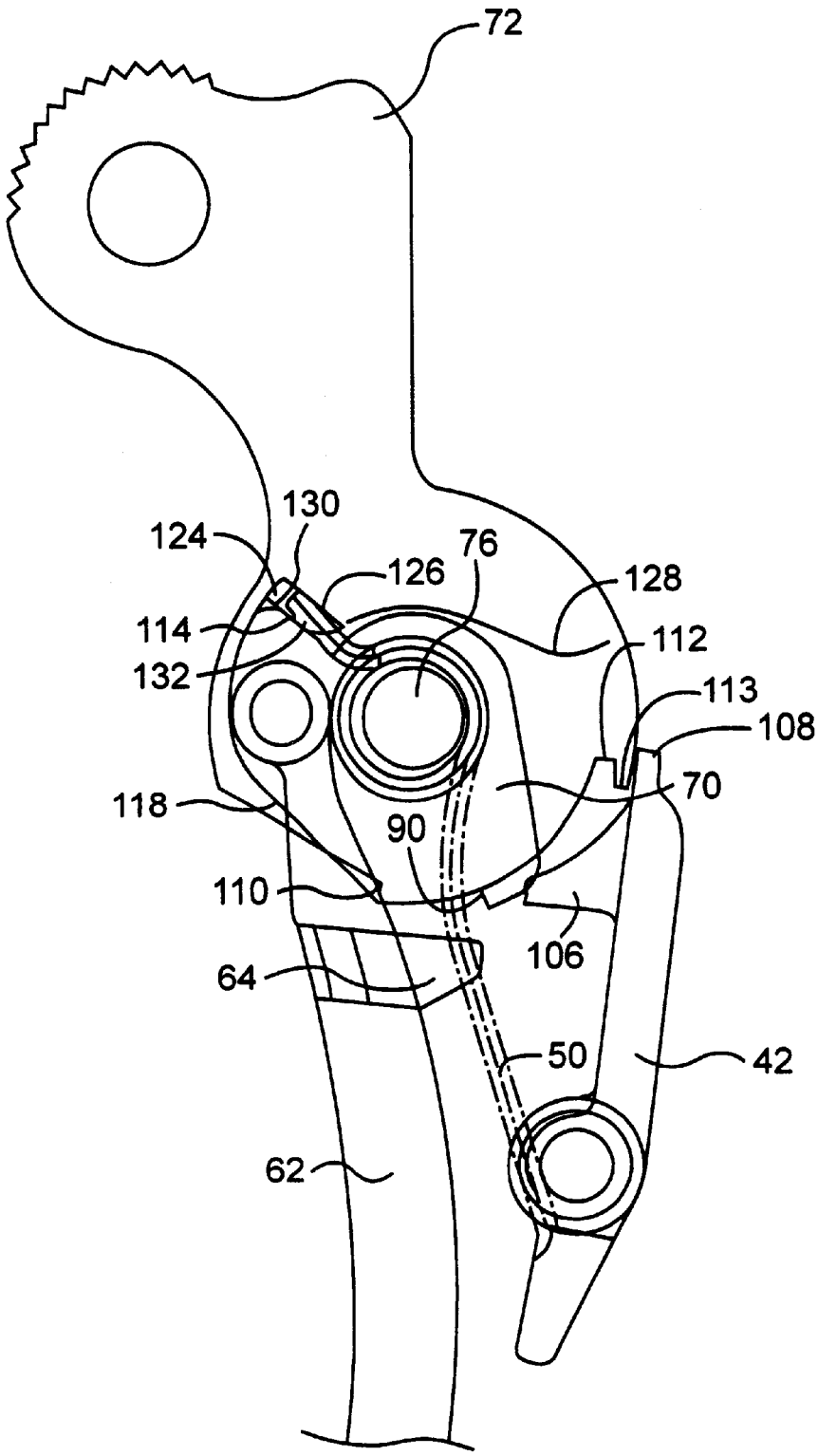
FIG. 5 is a side view of a firing assembly of the pistol of the present invention, illustrating the hammer cam in the uncocked position.
Figure 6:
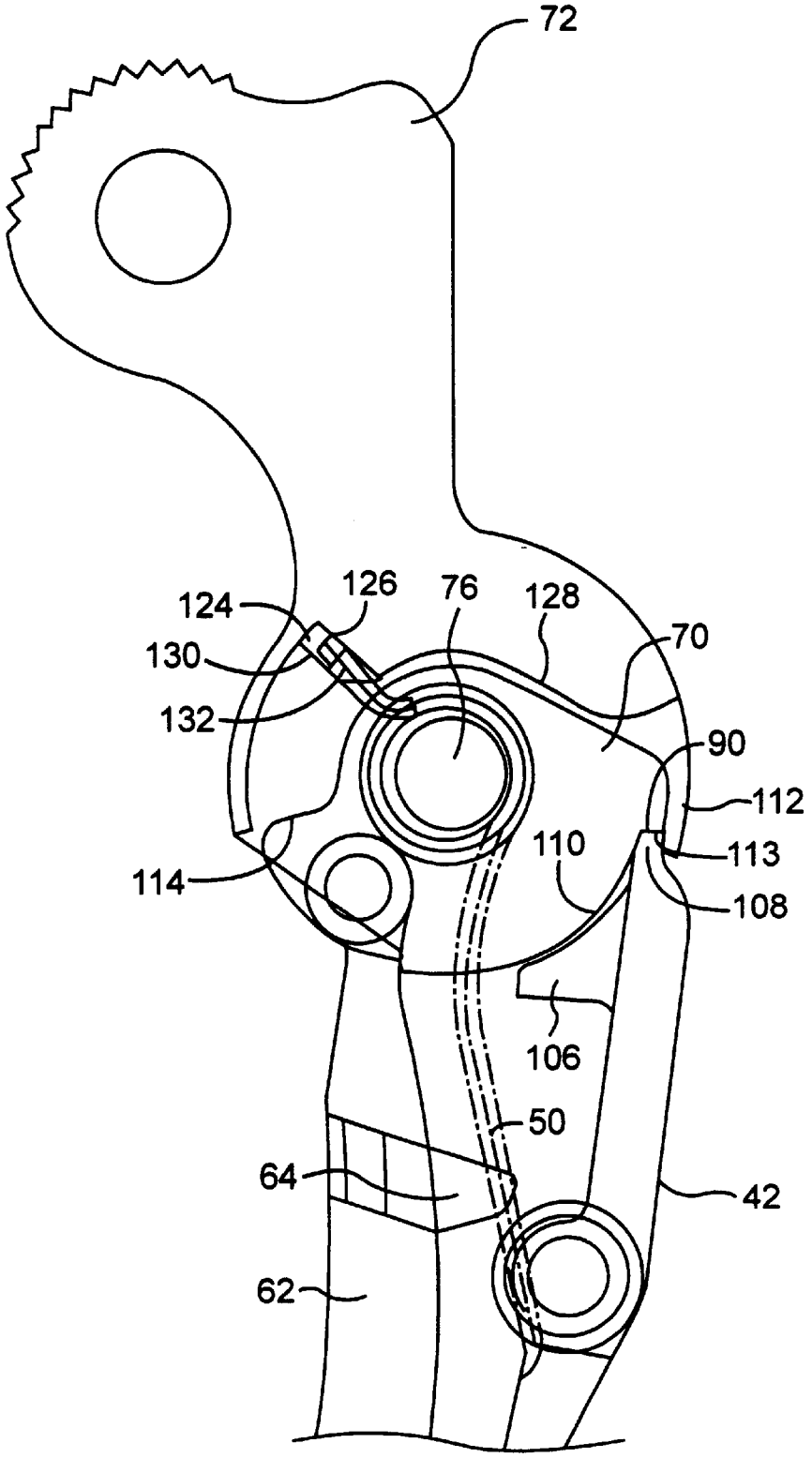
FIG. 6 is a side view of the firing assembly of FIG. 5, illustrating the hammer cam in the cocked position.

As shown in FIGS. 5 and 6, hammer cam 70 is detachably coupled with hammer 72. As illustrated in FIG. 5, hammer cam 70 is preferably positioned between the side supports 120 and 122 of hammer 72. Both hammer 72 and hammer cam 70 are rotatably disposed on hammer pin 76. When, as shown in FIG. 5, hammer cam 70 is in the uncocked position, second engagement step 114 of hammer cam 70 engages cam contact 130 of hammer 72. Because of this engagement, a rearward rotation of hammer 72 will translate to a corresponding rotation of hammer cam 70.

As shown in FIG. 6, after hammer 72 and hammer cam 70 have been rotated through a certain angle, main contact 108 of sear engages first engagement step 90 of hammer cam. Preferably, sear 42 will engage first engagement step 90 of hammer cam 70 after the hammer and hammer cam have been rotated about 60°.

After sear 42 engages hammer cam 70, upper portion 132 of hammer return spring 50 biases the hammer away from the hammer cam. Hammer 72 rotates forwardly until half-cock notches 112 engage main contact 108 of sear 42. Thus, the hammer cam remains engaged with sear 42 to hold hammer spring 56 compressed while hammer 72 is biased into the half-cocked position.

In a preferred embodiment, tabs 113 extend along main contact 108 of sear 42. Tabs 113 are configured to prevent sear 42 from disengaging hammer 72 when hammer 72 is in the half-cocked position. This configuration will prevent the accidental disengagement of the sear from the hammer and hammer cam.

In accordance with the present invention, the drawbar is operable to engage the hammer to rotate the hammer into close proximity of the hammer cam. The drawbar is further operable to disengage the sear from the hammer cam to release the hammer spring.

Figure 7:
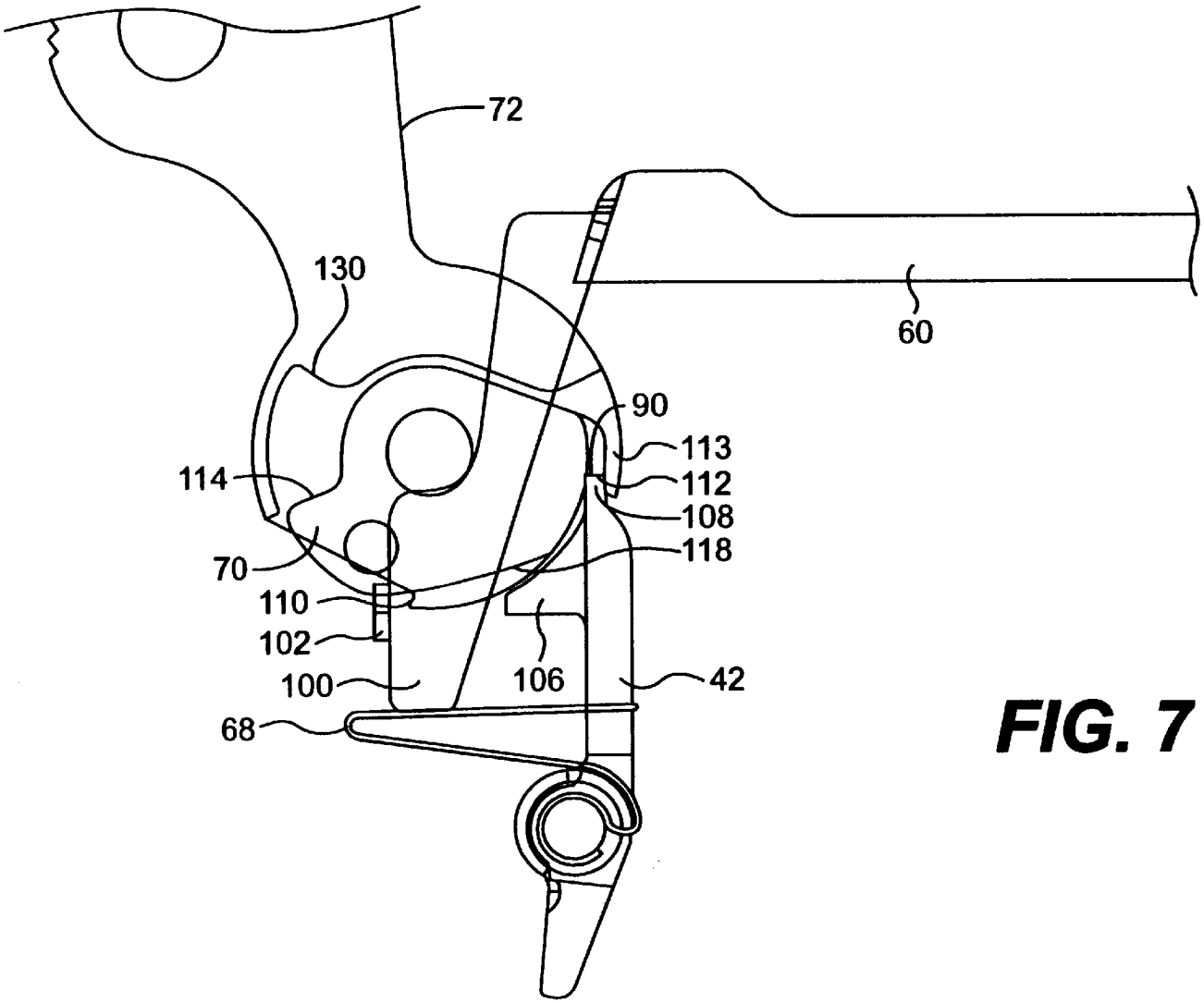
FIG. 7 is a side view of a firing assembly and a drawbar of the present invention, illustrating the hammer cam in the cocked position.

As illustrated in FIG. 7, drawbar 60 is positioned such that rear tab 102 is adjacent hammer 72. Trigger spring 48 acts indirectly through the trigger on drawbar 60 to bias it into a rearward position and drawbar spring 68 acts on rear leg 100 to bias drawbar upwardly. Alternatively, a spring may act directly on the drawbar to bias it rearwardly. The upward bias of drawbar spring 68 ensures that rear tab 102 will engage drawbar notch 110 of hammer 72. Rear tab 102 is also aligned with drawbar contact 106 of sear 42.

Figure 8:
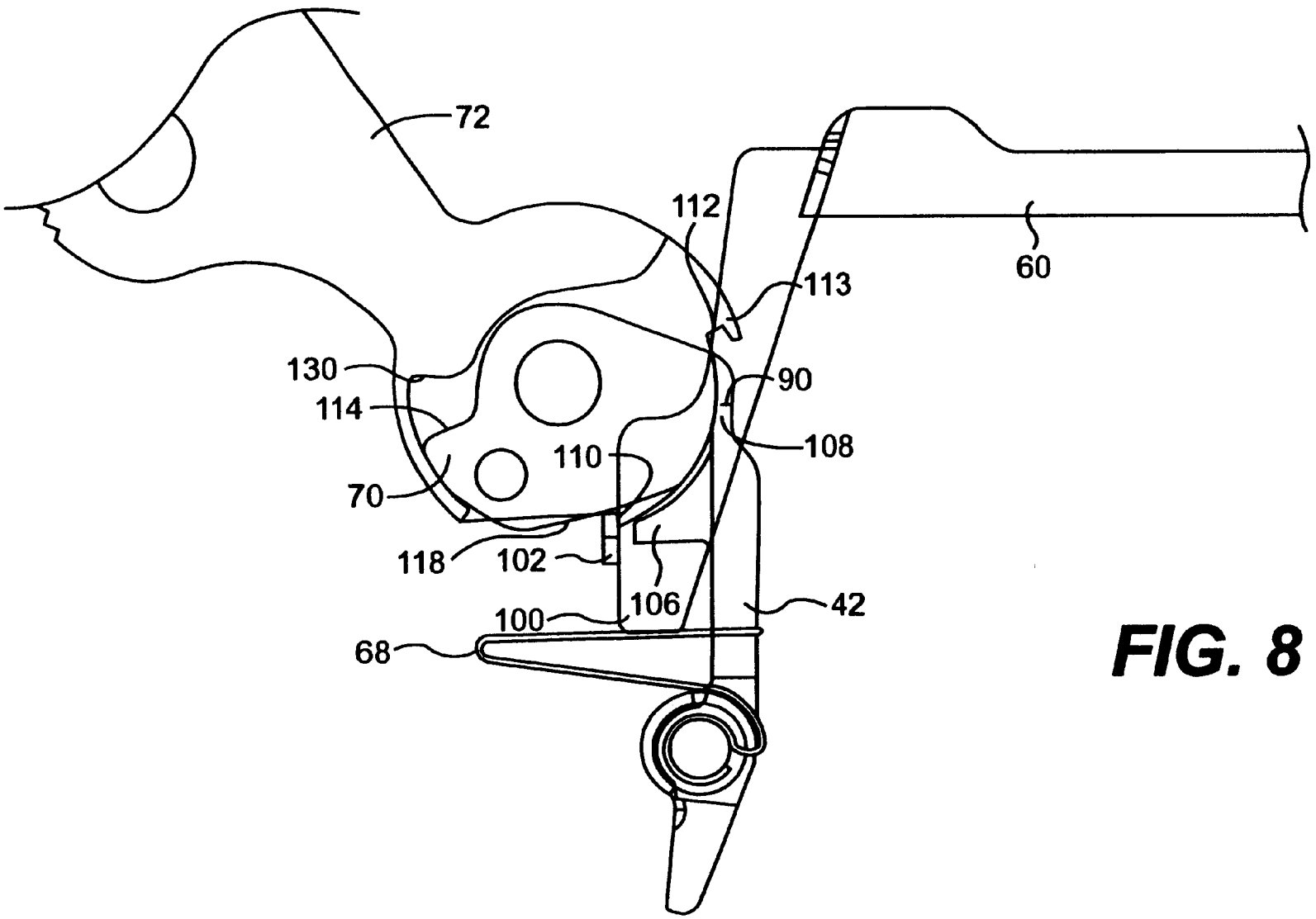
FIG. 8 is a side view of the firing assembly and drawbar of FIG. 7, illustrating the engagement of the drawbar with the hammer.

As shown in FIG. 8, when drawbar 60 moves forward in response to a trigger pull, rear tab 102 engages drawbar contact 110 on hammer 72 and causes hammer 72 to rotate rearwardly. As the trigger pull continues, rear tab 102 of drawbar will eventually contact with drawbar engagement 106 of sear 42. Rear tab 102 disengages sear 42 from hammer cam 72 thereby releasing the compressed hammer spring 56.

When hammer spring 56 is released, it acts through strut 62 to cause hammer cam 72 to rotate. As hammer cam 70 rotates, second engagement step 114 of hammer cam 70 approaches cam contact 130 of hammer 72. Just prior to second engagement step 114 engaging cam contact 130, surface 118 of hammer cam 70 contacts rear tab 102 of the drawbar. The contact moves rear tab 102 away from drawbar notch 110 to release hammer 72. The second engagement step 114 then contacts cam contact 130 of hammer 72 to rotate it forwardly to fire the pistol.

The preferred mechanism described above allows for the geometry of the cam to effectively control the handgun operation. That is, rather than allowing the drawbar to release the hammer on its own, the hammer cam contacts the hammer in the rear, with a substantially simultaneous release of the drawbar from the hammer. This mechanism allows the hammer cam and hammer to move together in a firing operation.

In a preferred embodiment, a boss 64 is disposed on strut 62 to prevent drawbar 60 from moving unless hammer cam 70 is in the cocked position. As shown in FIG. 5, when the hammer cam 70 is in the uncocked position, boss 64 is positioned directly below hammer 72. In this position, boss 64 is aligned with the rear tab 102 of drawbar 60 to prevent drawbar 60 from moving rearward and into engagement with hammer 72.

As illustrated in FIG. 6, when hammer cam 70 is cocked, strut 62 and boss 80 have moved downwardly to compress hammer spring 56. In the lowered position, boss 80 is no longer engaged with rear tab 102 of drawbar 60. Thus, trigger spring 48 biases drawbar 60 rearwardly to engage drawbar notch 110 of hammer 72.

In the exemplary embodiment, a manual safety is provided to prevent accidental firing of the pistol. The manual safety device can be engaged with the hammer to prevent the hammer from rotating when the safety device is in a safe position.

As shown in FIG. 2, pistol 30 includes a manual safety device 78. Manual safety device 78 has a pin 79 and a boss 80. As illustrated in FIG. 1, manual safety device 78 is mounted on the exterior of frame 40. Referring to FIG. 2, pin 79 extends through a hole 77 in frame 40. This configuration allows manual safety device 78 to pivot about pin 79. In this manner, boss 80 can be moved up or down at the discretion of the user of the pistol.

Figure 9:
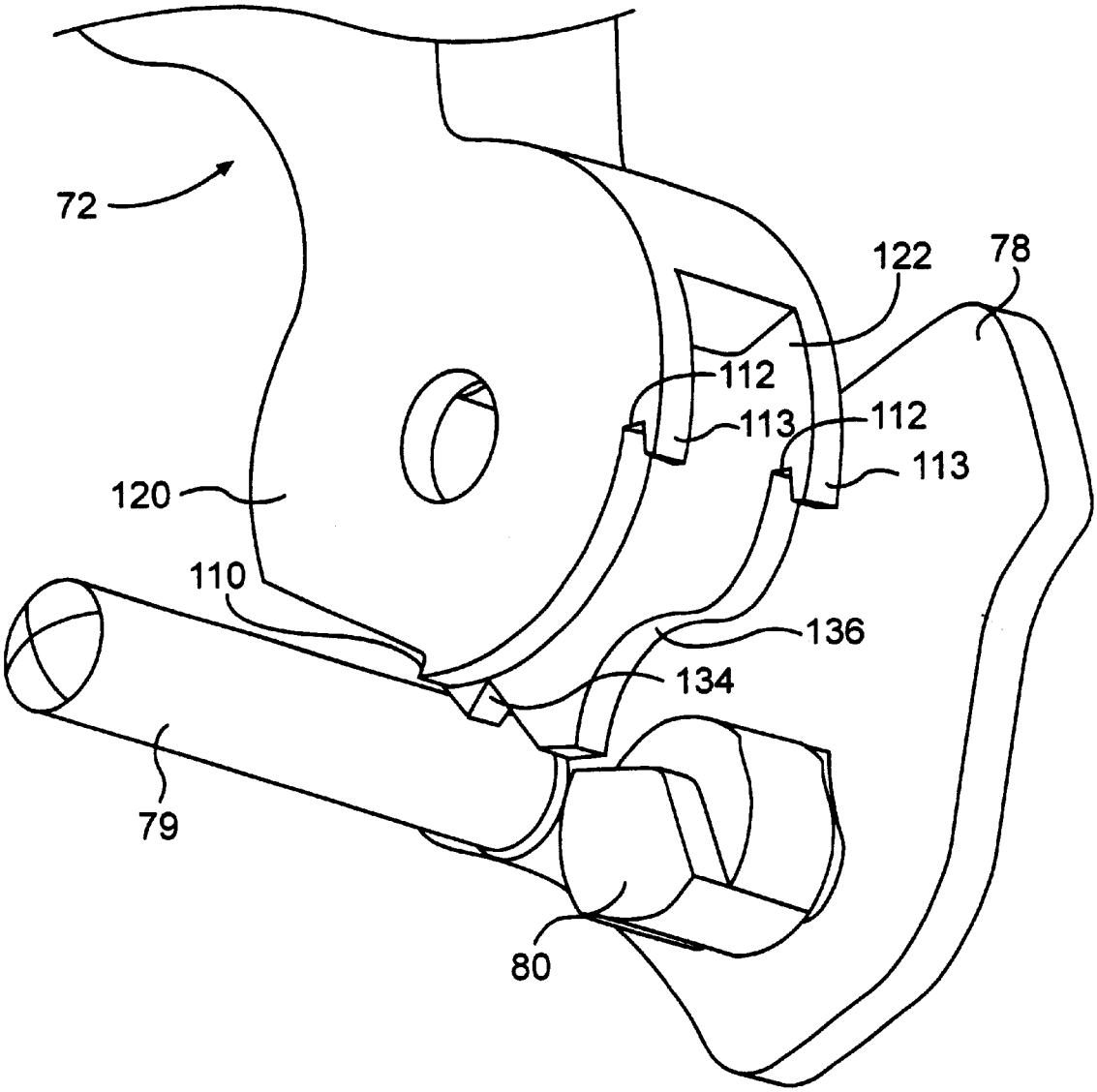
FIG. 9 is a partial pictorial view of a manual safety device of the present invention.
Figure 10:
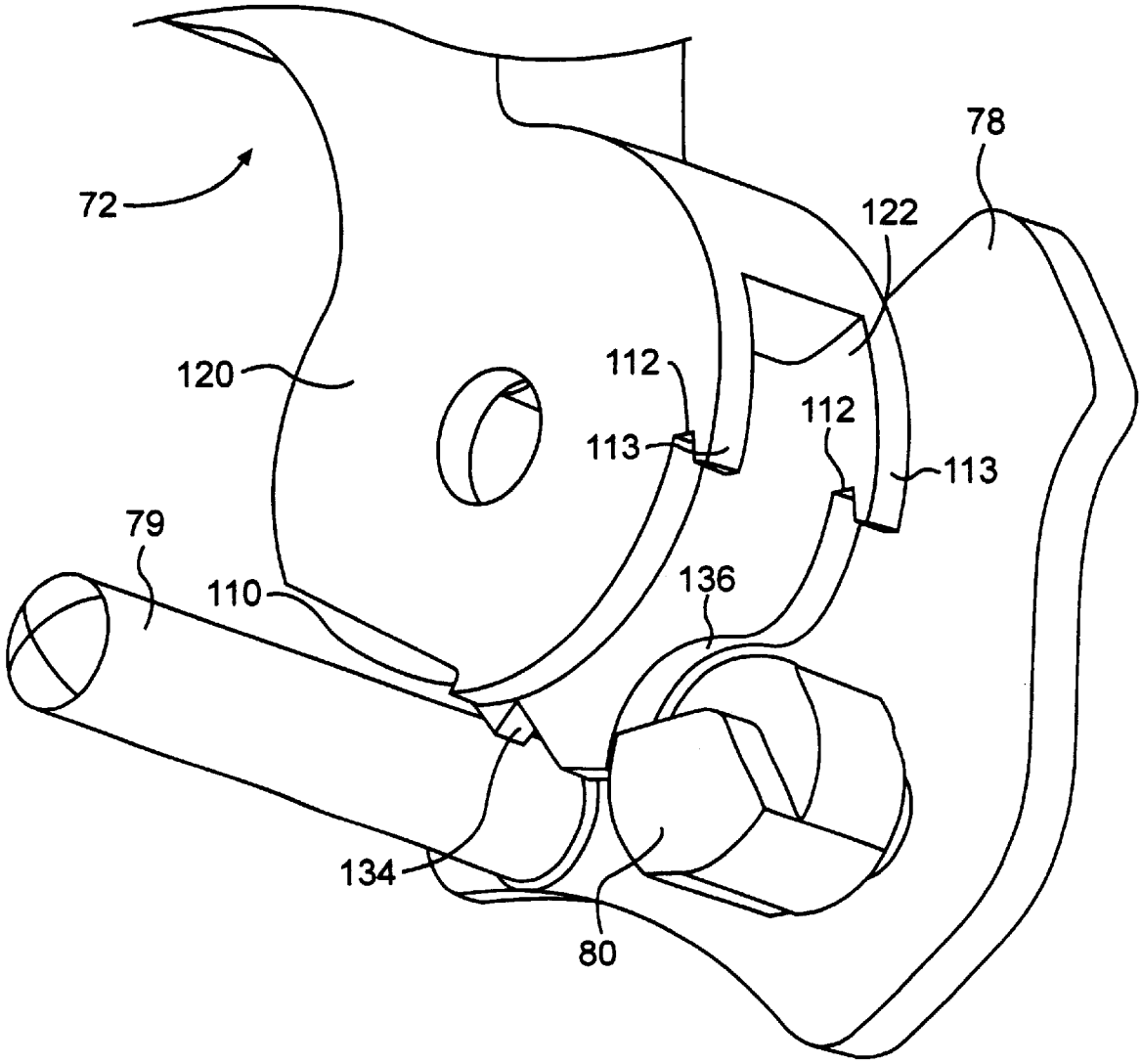
FIG. 10 is a partial pictorial view of the safety device of FIG. 9, illustrating the safety position.

In the firing position, as illustrated in FIG. 9, boss 80 of manual safety device 78 is removed from manual safety groove 136 so that hammer 72 may rotate freely. As shown in FIG. 10, manual safety device 78 may be pivoted upwardly to move boss 80 into engagement with manual safety groove 136. In this safe position, the engagement of the boss 80 with the manual safety groove 136 prevents hammer 72 from rotating. In this manner, the user may selectively lock and unlock the hammer to prevent accidental firing of the pistol.

In the exemplary embodiment, a grip safety device is also provided. The grip safety device can be engaged with a grip safety notch in the hammer to prevent the hammer from rotating when the grip safety is in a safe position.

Figure 11:
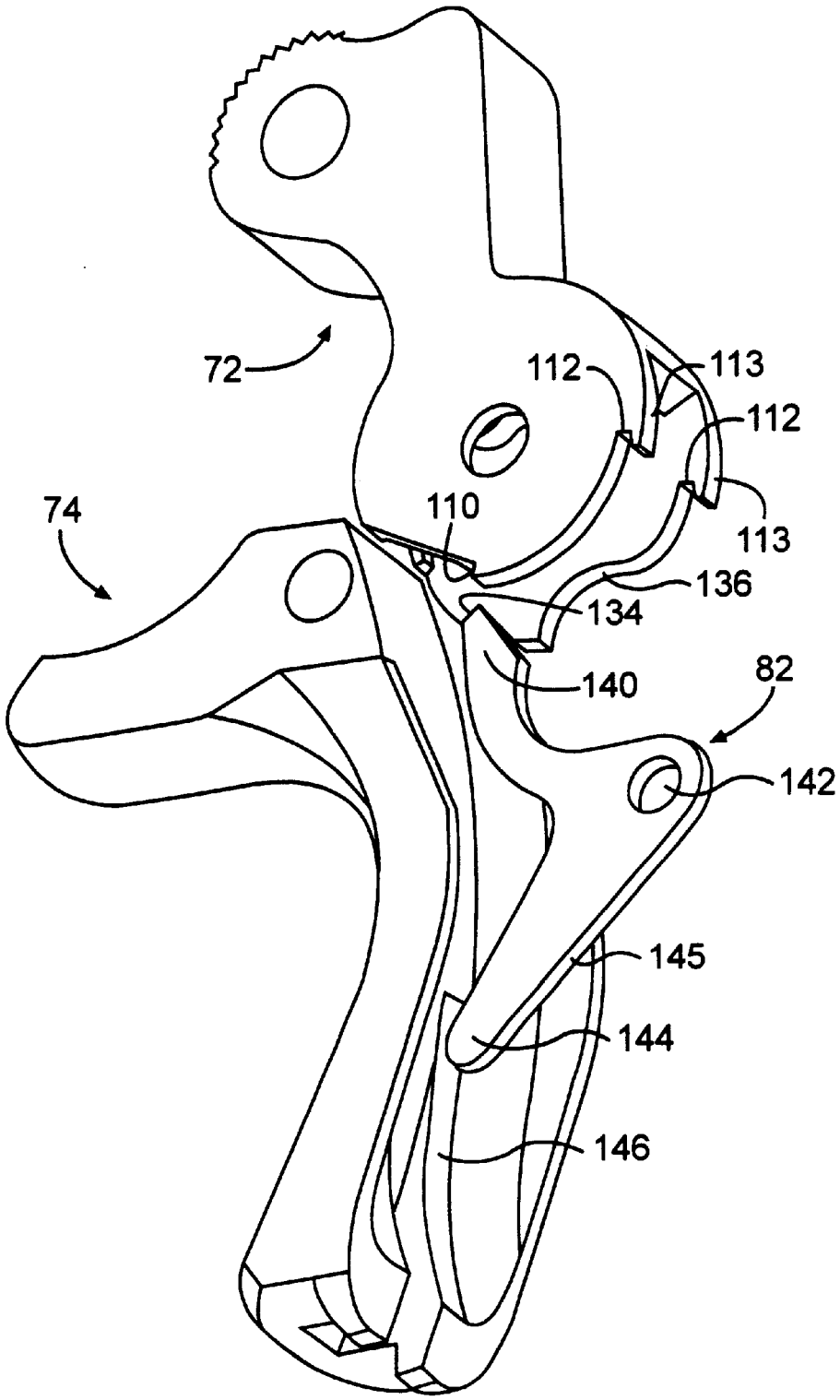
FIG. 11 is partial pictorial view of a grip safety of the present invention.

As illustrated in FIG. 2, pistol 30 includes a grip 74 and a grip safety 82. As shown in FIG. 11, grip safety 82 has an opening 142, an upper end 140 and a lower end 144. Opening 142 engages sear pin 44 to allow grip safety 82 to rotate. Upper end 140 is engageable with grip safety notch 134 in hammer 72 and lower end 144 slides along surface 146 of grip 74.

As shown in FIG. 2, leaf spring 52 has a grip prong 84 and a grip safety prong 88. Grip prong 84 acts on grip 74 to bias the grip to a rearward position. Grip safety prong 88 acts on lower end 145 of grip safety 82 to rotate upper end 140 into engagement with grip safety notch 134 of hammer 72.

As illustrated in FIG. 11, when grip 74 is not being held, leaf spring 50 biases grip safety 82 into the safe position, where the upper end 140 of grip safety 82 engages grip safety notch 134 of hammer 72. This engagement prevents the hammer from rotating when the grip is not being held. This will prevent the pistol from firing unless the pistol is properly held. Alternatively, the grip safety may be designed to block another pistol component, such as the sear or drawbar.

Figure 12:
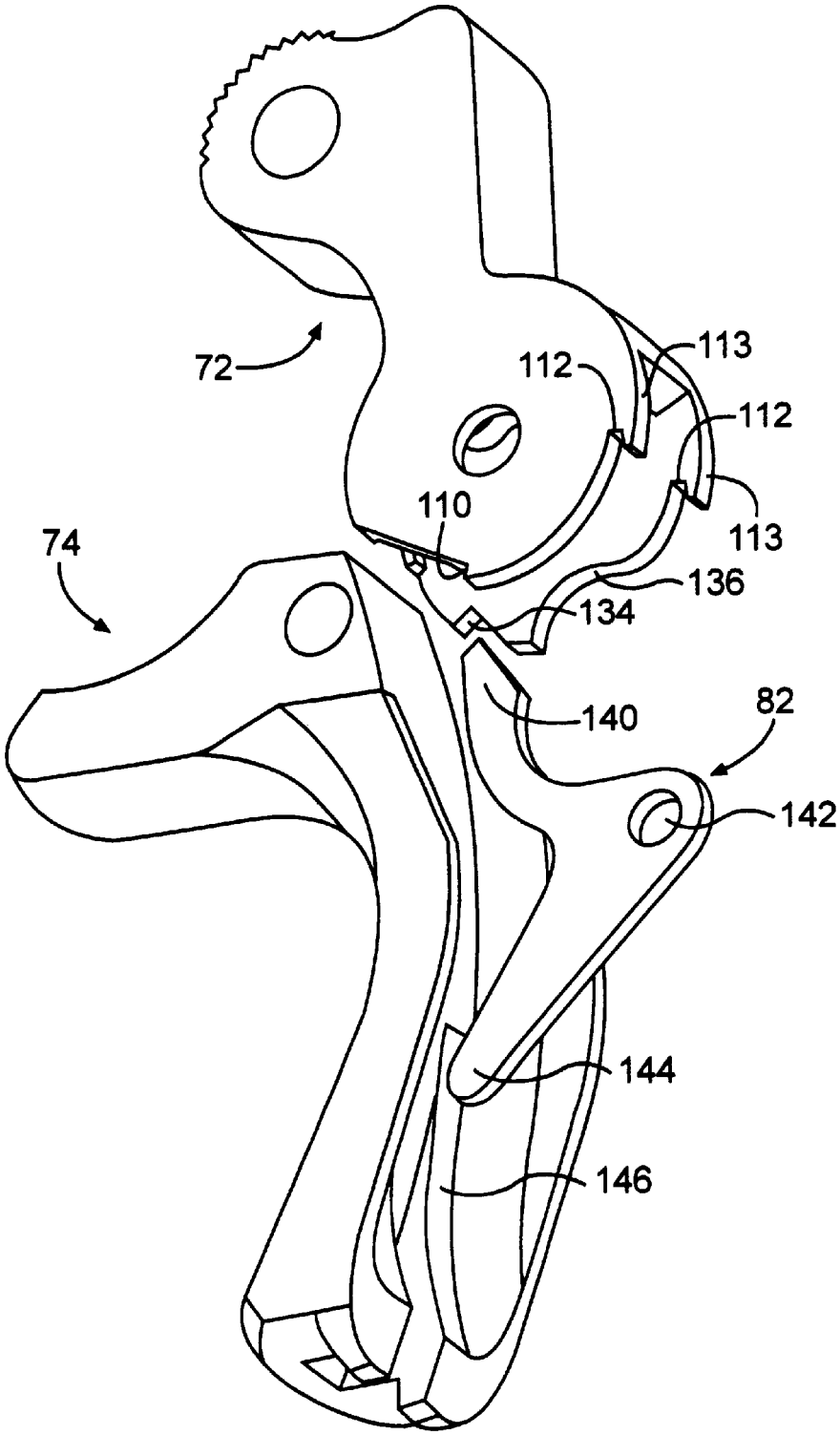
FIG. 12 is a partial pictorial view of the grip safety of FIG. 11, illustrating the firing position.

As illustrated in FIG. 12, when the user grips the pistol 30, the force of the grip overcomes the bias of leaf spring 52 and grip 74 moves to a forward position. As grip 74 moves, lower end 144 of grip safety 82 slides along surface 146 of grip 74, thereby causing grip safety 82 to rotate. This rotation causes upper end 140 of grip safety 82 to rotate out of engagement with grip safety notch 134 of hammer 72. In this firing position, hammer 72 may freely rotate and the pistol may be fired.

The operation of a preferred embodiment of the aforementioned device will now be described with reference to the attached drawings. As illustrated in FIG. 13, the operation of the pistol begins with hammer 72 in the uncocked position. The hammer cam 70 is also uncocked and hammer spring 56 is expanded. The trigger 46 is positioned between the rearward and forward positions, because boss 64 on strut 62 is engaged with rear tab 102 of drawbar 60. This engagement prevents the trigger spring 48 from biasing trigger 46 to the fully forward position.

Figure 14:
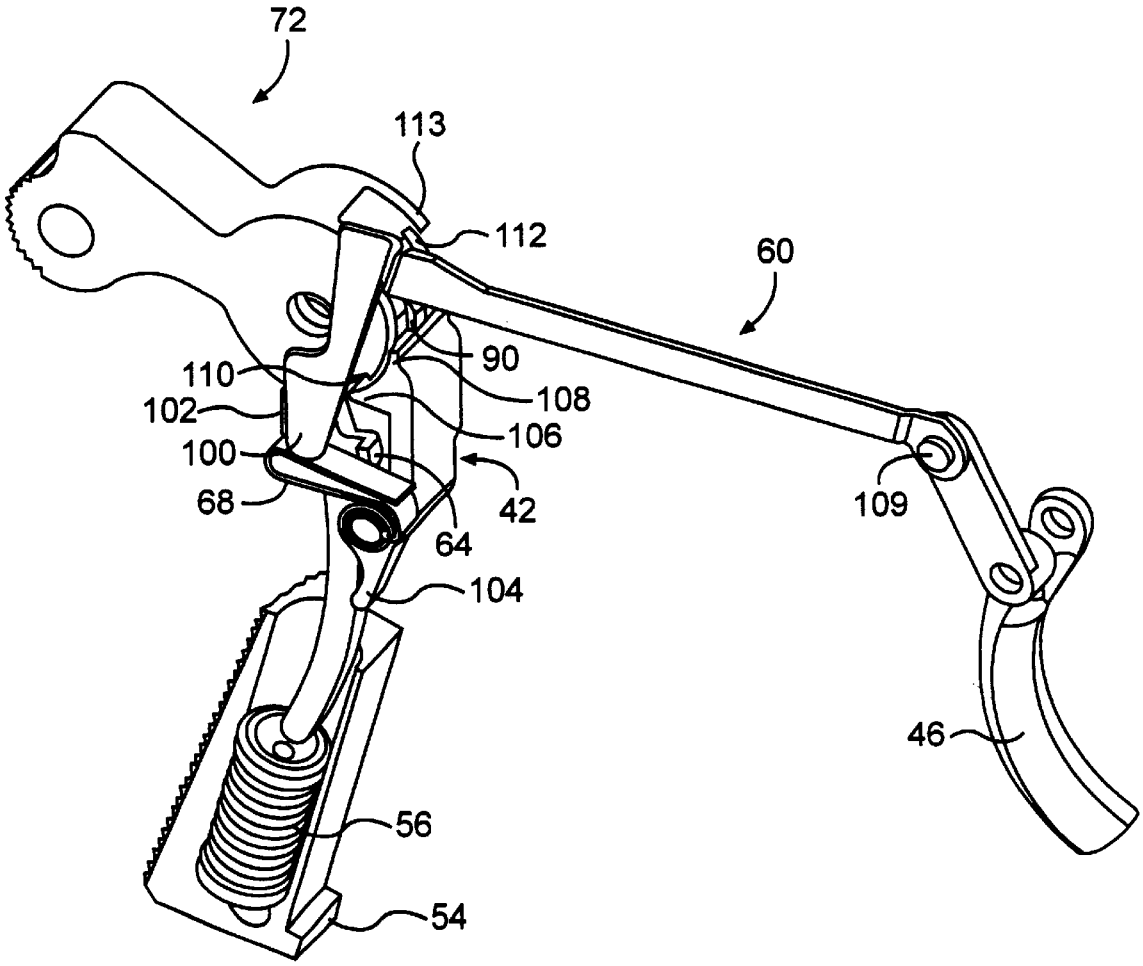
FIG. 14 is a partial pictorial view of the trigger and firing assemblies of FIG. 13, illustrating the cocked position of the hammer cam.

Before the pistol can be fired, hammer cam 70 must be cocked. This is accomplished by manually retracting the hammer 72 as illustrated in FIG. 14. The retraction of hammer 72 causes a corresponding rotation of hammer cam 70. The rotation of hammer cam 70 moves strut 62 downward to compress hammer spring 56. The downward motion of strut 62 moves boss 64 out of engagement with rear tab 102 of drawbar 60. The bias of trigger spring 48 moves trigger 46 to the full forward position. Drawbar spring 68 acts on the rear leg 100 of the drawbar to move the rear tab 102 into contact with the surface of the first support 120 of hammer 72.

When hammer 72 has been retracted approximately 60°, sear spring 86 biases sear 42 into engagement with first engagement step 90 of hammer cam 70. Main contact 108 of sear 42 holds hammer cam 70 to maintain the compression of hammer spring 56. In this manner, hammer spring 56 is compressed to store energy for later use in firing the pistol.

Figure 15:
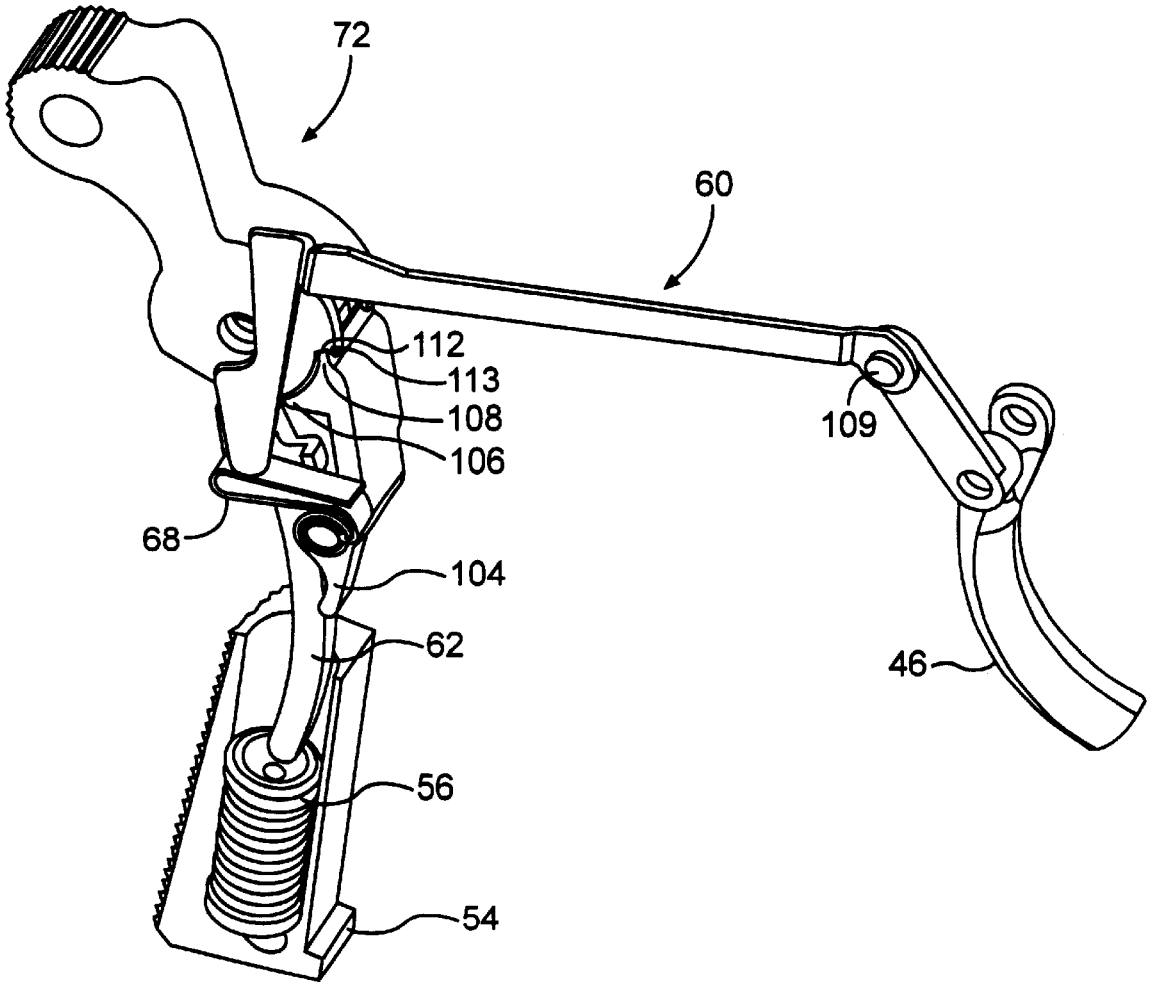
FIG. 15 is a partial pictorial view of the trigger and firing assemblies of FIG. 13, illustrating the half-cocked position of the hammer.

As illustrated in FIG. 15, when hammer 72 is released, return spring 50 acts on hammer 72 to bias it away from hammer cam 70. Hammer 72 rotates forwardly until main contact 108 of sear 42 engages half-cock notches 112 of hammer 72 to hold the hammer in the half-cocked position. Tabs 113 are configured to prevent the sear 42 from disengaging the hammer 72. This will prevent the pistol from being fired from the half-cocked position. Thus, a deliberate action on the part of the user will be required to fire the pistol and an accidental bumping will not fire the weapon.

Figure 16:
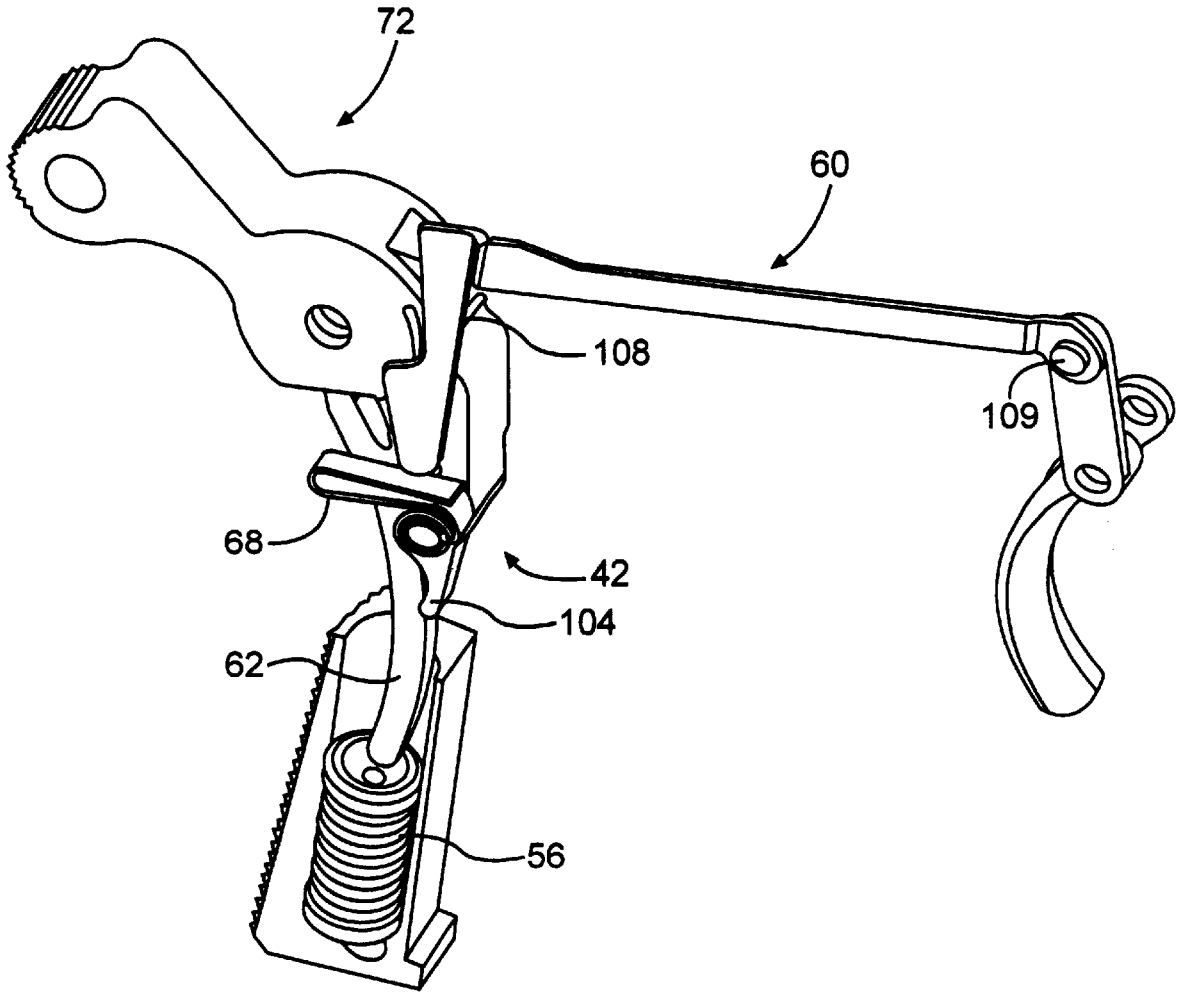
FIG. 16 is a partial pictorial view of the trigger and firing assemblies of FIG. 13, illustrating the firing position.

To fire the pistol, the trigger is pulled. As illustrated in FIG. 16, rear tab 102 of drawbar engages drawbar notch 110 of hammer 72. As trigger 46 is pulled, hammer 72 rotates rearwardly until cam contact 130 of hammer 72 is in close proximity to second engagement step 114 of cam 70. Because the hammer spring is already compressed, the trigger pull must only overcome the opposing forces of return spring 50 and trigger spring 48 to retract hammer 72. Thus, the force required to pull the trigger of the present invention is less than the force required in a typical double action pistol.

Rear tab 102 of drawbar then contacts the drawbar contact of sear 42 to disengage the sear from hammer cam 70. The compressed hammer spring 56 then acts on hammer cam 70 to rotate the hammer cam 70 forwardly. Second engagement step 114 of hammer cam 70 engages cam contact 130 of hammer 72 to rotate hammer forward. As hammer cam 70 rotates, the lower surface of the hammer cam contacts rear tab 102 of drawbar. The force of hammer spring 56 overcomes the force of the drawbar spring 68 and rear tab 102 is disengaged from the drawbar notch 110 of hammer 72. Thus, hammer 72 is free to rotate with the force from hammer spring 56 to fire the pistol.

The recoil action of each fired shot is used to retract the hammer and thereby compress the hammer spring. As shown in FIG. 14, the hammer 72 is retracted through at least 60° and sear 42 again engages the hammer cam 70 to hold hammer spring 56 compressed. Return spring 50 biases hammer 72 into the half-cocked position.

Thus, the present invention provides a pistol that incorporates the accuracy advantages of a single action pistol with the safety advantages of a double action pistol. The accuracy advantages of the single action pistol are attained by providing a consistent and light trigger force. The safety advantages of the double action pistol are met by providing a longer trigger pull. Therefore, the present invention provides a safe and accurate double action pistol.

It will be apparent to those skilled in the art that various modifications and variations can be made in the construction of this double action pistol without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A double action pistol having a frame, a hammer spring, and a sear mounted on the frame, the pistol comprising:

a hammer cam disposed adjacent the sear and connected to the hammer spring, the hammer cam having a cocked position where the hammer cam is engaged with the sear to hold the hammer spring in a compressed position and an uncocked position where the hammer spring is expanded;

a hammer rotatably disposed on the frame and selectively engageable with the hammer cam, wherein a rearward rotation of the hammer causes a corresponding rotation of the hammer cam to move the hammer cam from the uncocked position to the cocked position; and a grip safety engageable with the hammer to prevent the hammer from moving the hammer cam from the uncocked to the cocked position.

2. The pistol of claim 1, wherein the hammer cam includes an engaging step, the hammer contacting the engaging step of the hammer cam to move the hammer cam to the cocked position.

3. The pistol of claim 2, further comprising a hammer return spring acting on the hammer to bias the hammer away from the engaging step of the hammer cam.

4. The pistol of claim 1, wherein the hammer has a first side support and a second side support, one of the first and second side supports having a safety notch configured to engage the grip safety.

5. The pistol of claim 4, wherein the grip safety includes an end configured to engage the safety notch of the hammer.

6. The pistol of claim 4, wherein the hammer cam is rotatably disposed between the first and second side supports of the hammer.

7. The pistol of claim 4, further comprising a grip disposed in the frame, the grip operatively connected to the grip safety to selectively disengage the grip safety from the safety notch in the hammer.

8. The pistol of claim 7, further comprising a grip safety spring acting on the grip safety to bias the grip safety into engagement with the safety notch in the hammer.

9. The pistol of claim 1, wherein the hammer cam engages the hammer when the hammer cam moves from the cocked position to the uncocked position to discharge the pistol.

10. A semi-automatic pistol, comprising:

a frame;

a sear disposed on the frame, a hammer disposed on the frame and moveable between a forward position and a rearward position;

a hammer spring;

a barrel pivotally linked to the frame;

a hammer cam operatively connected to the hammer spring and selectively engageable with the hammer, the hammer cam having a cocked position where the hammer cam is engaged with the sear to hold the hammer spring in a compressed position and an uncocked position where the hammer spring is expanded, the hammer cam selectively engageable with the hammer such that a rearward rotation of the hammer moves the hammer cam from the uncocked position to the cocked position; and a grip safety engageable with the hammer to prevent the hammer from moving the hammer cam from the uncocked to the cocked position.

11. The semi-automatic pistol of claim 10, wherein the hammer cam engages the hammer when the hammer cam moves from the cocked position to the uncocked position to discharge the pistol.

12. The semi-automatic pistol of claim 10, wherein the hammer cam includes an engaging step and the hammer contacts the engaging step when moving the hammer cam to the cocked position.

13. The semi-automatic pistol of claim 12, further comprising a hammer return spring acting on the hammer to bias the hammer away from the engaging step of the hammer cam.

14. The semi-automatic pistol of claim 10, wherein the hammer has a first side support and a second side support, one of the first and second side supports having a safety notch configured to receive an end of the grip safety.

15. The semi-automatic pistol of claim 14, wherein the hammer cam is rotatably disposed between said first and second side supports of the hammer.

16. The semi-automatic pistol of claim 14, further comprising a frame and a grip disposed in the frame, the grip operatively connected to the grip safety to selectively disengage the grip safety from the safety notch of the hammer.

17. The semi-automatic pistol of claim 16, further comprising a grip safety spring acting on the grip safety to bias the grip safety into engagement with the safety notch of the hammer.

18. A semi-automatic pistol, comprising:

a frame;

a sear disposed on the frame, a hammer disposed on the frame and moveable between a forward position and a rearward position;

a hammer spring;

a slide mounted on the frame for sliding movement between a forward position and a rearward position;

a slide stop disposed on the frame and configured to selectively engage the slide and prevent the slide from moving to the forward position;

a hammer cam operatively connected to the hammer spring and selectively engageable with the hammer, the hammer cam having a cocked position where the hammer cam is engaged with the sear to hold the hammer spring in a compressed position and an uncocked position where the hammer spring is expanded, the hammer cam selectively engageable with the hammer such that a rearward rotation of the hammer moves the hammer cam from the uncocked position to the cocked position; and a grip safety engageable with the hammer to prevent the hammer from moving the hammer cam from the uncocked to the cocked position.

19. The semi-automatic pistol of claim 18, wherein the hammer cam engages the hammer when the hammer cam moves from the cocked position to the uncocked position to discharge the pistol.

20. The semi-automatic pistol of claim 18, wherein the hammer cam includes an engaging step and the hammer contacts the engaging step when moving the hammer cam to the cocked position.

21. The semi-automatic pistol of claim 20, further comprising a hammer return spring acting on the hammer to bias the hammer away from the engaging step of the hammer cam.

22. The semi-automatic pistol of claim 18, wherein the hammer has a first side support and a second side support, one of the first and second side supports having a safety notch configured to receive an end of the grip safety.

23. The semi-automatic pistol of claim 22, wherein the hammer cam is rotatably disposed between said first and second side supports of the hammer.

24. The semi-automatic pistol of claim 23, further comprising a frame and a grip disposed in the frame, the grip operatively connected to the grip safety to selectively disengage the grip safety from the safety notch of the hammer.

25. The semi-automatic pistol of claim 24, further comprising a grip safety spring acting on the grip safety to bias the grip safety into engagement with the safety notch of the hammer.

* * * * *